US012270556B2

(12) United States Patent
Lin

(10) Patent No.: US 12,270,556 B2
(45) Date of Patent: Apr. 8, 2025

(54) PANEL ASSEMBLY OF CEILING-EMBEDDED AIR CONDITIONER AND CEILING-EMBEDDED AIR CONDITIONER HAVING THE SAME

(71) Applicant: GD MIDEA AIR-CONDITIONING EQUIPMENT CO., LTD., Foshan (CN)

(72) Inventor: Chao Lin, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 477 days.

(21) Appl. No.: 17/765,161

(22) PCT Filed: Nov. 26, 2019

(86) PCT No.: PCT/CN2019/120868
§ 371 (c)(1),
(2) Date: Mar. 30, 2022

(87) PCT Pub. No.: WO2021/082141
PCT Pub. Date: May 6, 2021

(65) Prior Publication Data

US 2022/0341602 A1 Oct. 27, 2022

(30) Foreign Application Priority Data

Oct. 31, 2019 (CN) ..... 201921862993.8

(51) Int. Cl.
*F24F 1/0047* (2019.01)

(52) U.S. Cl.
CPC ..... *F24F 1/0047* (2019.02)

(58) Field of Classification Search
CPC .. F24F 13/082; F24F 13/1413; F24F 2221/14; F24F 1/0047

(Continued)

(56) References Cited

U.S. PATENT DOCUMENTS 5,577,958 A * 11/1996 Kumekawa ..... F24F 13/081 454/304
5,771,708 A * 6/1998 Suzuki ..... F24F 1/0057 62/296

(Continued)

FOREIGN PATENT DOCUMENTS

CN 107830578 A 3/2018
CN 107830579 A 3/2018

(Continued)

OTHER PUBLICATIONS

The European Patent Office (EPO) Extended Search Report for EP Application No. 19951078.5 Sep. 27, 2022 9 Pages.

(Continued)

*Primary Examiner* — Avinash A Savani
*Assistant Examiner* — Dana K Tighe
(74) *Attorney, Agent, or Firm* — Anova Law Group, PLLC

(57) ABSTRACT

A panel assembly includes a panel frame having one or more air outlets surrounding a reference axis. The one or more air outlets include an adjustable port having a port inner edge close to the reference axis and a port outer edge away from the reference axis. On the reference axis, a projection of the port inner edge is located on a side of a projection of the port outer edge facing an outer end of the reference axis. The panel assembly further includes an adjustable plate movably arranged at the adjustable port and having a low-wind-feeling position, at which a plate inner edge of the adjustable plate is close or linked to the port inner edge, and a radial air outlet configured to output air in a direction away from the reference axis is formed between the port outer edge and a plate outer edge of the adjustable plate.

18 Claims, 4 Drawing Sheets

(58) Field of Classification Search
USPC ..... 454/237, 270
See application file for complete search history.

(56) References Cited

U.S. PATENT DOCUMENTS

| | | | | |
|---|---|---|---|---|
| 9,897,335 | B2 * | 2/2018 | Nouchi | F24F 1/0047 |
| 10,288,302 | B2 * | 5/2019 | Fujita | F24F 13/30 |
| 11,408,618 | B2 * | 8/2022 | Iwase | F24F 13/30 |
| 2006/0276123 | A1 * | 12/2006 | Sanagi | F24F 1/0047<br>454/299 |
| 2008/0034775 | A1 * | 2/2008 | Choi | F24F 1/0014<br>62/259.1 |

FOREIGN PATENT DOCUMENTS

| | | | |
|---|---|---|---|
| CN | 108006818 | A | 5/2018 |
| CN | 208011911 | U | 10/2018 |
| EP | 1589292 | A1 | 10/2005 |
| EP | 2495503 | A1 | 9/2012 |
| EP | 2530395 | A1 | 12/2012 |
| EP | 3358265 | A1 | 8/2018 |
| JP | 2000283544 | A | 10/2000 |
| KR | 20190026325 | A | 3/2019 |
| WO | 2019059606 | A1 | 3/2019 |

OTHER PUBLICATIONS

World Intellectual Property Organization (WIPO) International Search Report and Written Opinion for PCT/CN2019/120868 May 14, 2020 20 Pages (with translation).

* cited by examiner

PANEL ASSEMBLY OF CEILING-EMBEDDED AIR CONDITIONER AND CEILING-EMBEDDED AIR CONDITIONER HAVING THE SAME

CROSS-REFERENCE TO RELATED APPLICATIONS

The present application is a National Stage Entry under 35 U.S.C. § 371 of International Application No. PCT/CN2019/120868, filed on Nov. 26, 2019, which is based upon and claims priority to Chinese Patent Application No. 201921862993.8, filed on Oct. 31, 2019, the entire contents of both of which are incorporated herein by reference.

TECHNICAL FIELD

The present disclosure relates to a technical field of household appliances, and more particularly to a panel assembly of a ceiling-embedded air conditioner and a ceiling-embedded air conditioner having the same.

BACKGROUND

In a related art, a panel assembly of a ceiling-embedded air conditioner is generally provided with panel frames and adjustable plates. An air outlet may be formed at the panel frame. The adjustable plate may adjust an air supply direction. On some panel assemblies, in a non-working state, the adjustable plate may cover the air outlet, while in a working state, the adjustable plate needs to ensure that at least a part of the air outlet is exposed. Most of a supplied airflow directly blows to user, resulting in less comfort. During a long-time use, direct blowing of the supplied airflow to the user may also cause physical discomfort to the user, such as headache, nasal congestion and other air-conditioning related diseases.

SUMMARY

The present disclosure aims to solve at least one of the technical problems existing in the related art. Therefore, the present disclosure provides a panel assembly of ceiling-embedded air conditioner to improve comfort experience for user and protect user's health.

The present disclosure further aims to provide a ceiling-embedded air conditioner having the above panel assembly to improve the comfort experience for user and protect user's health.

The panel assembly of the ceiling-embedded air conditioner according to the embodiments of the present disclosure includes a panel frame having a reference axis, two ends of the reference axis being an inner end and an outer end arranged at an inner side and an outer side of the panel assembly, respectively, the panel frame being provided with one or more air outlets surrounding the reference axis; at least one air outlet being an adjustable port, the adjustable port having a port inner edge close to the reference axis and a port outer edge away from the reference axis, on the reference axis, a projection of the port inner edge being located on a side of the projection of the port outer edge facing an outer end; an adjustable plate movably arranged at the adjustable port and having a low-wind-feeling position, an edge of the adjustable plate close to the reference axis being a plate inner edge, and an edge of the adjustable plate away from the reference axis being a plate outer edge; wherein in the low-wind-feeling position, the plate inner edge is close to or linked to the port inner edge, and a radial air outlet is formed between the plate outer edge and the port outer edge, the radial air outlet is configured to output air in a direction away from the reference axis.

For the panel assembly of the ceiling-embedded air conditioner according to the embodiments of the present disclosure, through the movable arrangement of the adjustable plate at the adjustable port, when the plate inner edge is close to or linked to the port inner edge, there is a height difference between the plate outer edge and the port outer edge in the direction of the reference axis, and a radial air outlet may be formed, such that the supplied airflow may blow in a direction away from the reference axis, so as to reduce the direct blowing of the airflow to the user, protect the user's health and improve the comfort experience for user.

In some embodiments, at the low-wind-feeling position, an air-output direction of the radial air outlet is perpendicular to the reference axis.

In some embodiments, at the low-wind-feeling position, a projection of the plate outer edge is located in a projection of the adjustable port on the reference axis.

In some embodiments, at the low-wind-feeling position, an appearance surface of the adjustable plate is tangent to an appearance surface of the panel frame at the plate inner edge.

In some embodiments, a distance between the port inner edge and the port outer edge in the direction of the reference axis is greater than 10 mm and less than 30 mm.

In some embodiments, the panel assembly of the ceiling-embedded air conditioner further includes a panel provided with an air inlet, the panel frame being in annular shape, the panel frame being fitted over the panel, and the reference axis being located on a central axis of the air inlet.

In some embodiments, the panel frame includes a first panel frame, the first panel frame is in annular shape, the first panel frame is fitted over an outer circumference of the panel, and a plurality of notches spaced apart from each other are arranged at an outer edge of the first panel frame; a second panel frame, the second panel frame is in annular shape, the second panel frame is fitted over an outer circumference of the first panel frame, an air outlet is formed between an inner wall of each notch and an inner peripheral wall of the second panel frame.

In some embodiments, all of the plurality of air outlets are adjustable ports, each of the adjustable ports is provided with a rotatable adjustable plate, and a rotation shaft of the adjustable plate is arranged close to the port inner edge.

In some embodiments, the panel is integrated with an air inlet grille at the air inlet.

The ceiling-embedded air conditioner according to the embodiments of the present disclosure includes the panel assembly of the ceiling-embedded air conditioner according to above embodiments.

For the ceiling-embedded air conditioner according to the embodiments of the present disclosure, through the movable arrangement of the adjustable plate at the adjustable port, when the plate inner edge is close to or linked to the port inner edge, there is a height difference between the plate outer edge and the port outer edge in the direction of the reference axis, and a radial air outlet may be formed, such that the supplied airflow may blow in a direction away from the reference axis, so as to reduce the direct blowing of the airflow to the user, protect the user's health and improve the comfort experience for user.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

The above and other aspects and advantages of embodiments of the present disclosure will become apparent and readily appreciated from the following descriptions made with reference to the drawings, in which.

Figure 1:
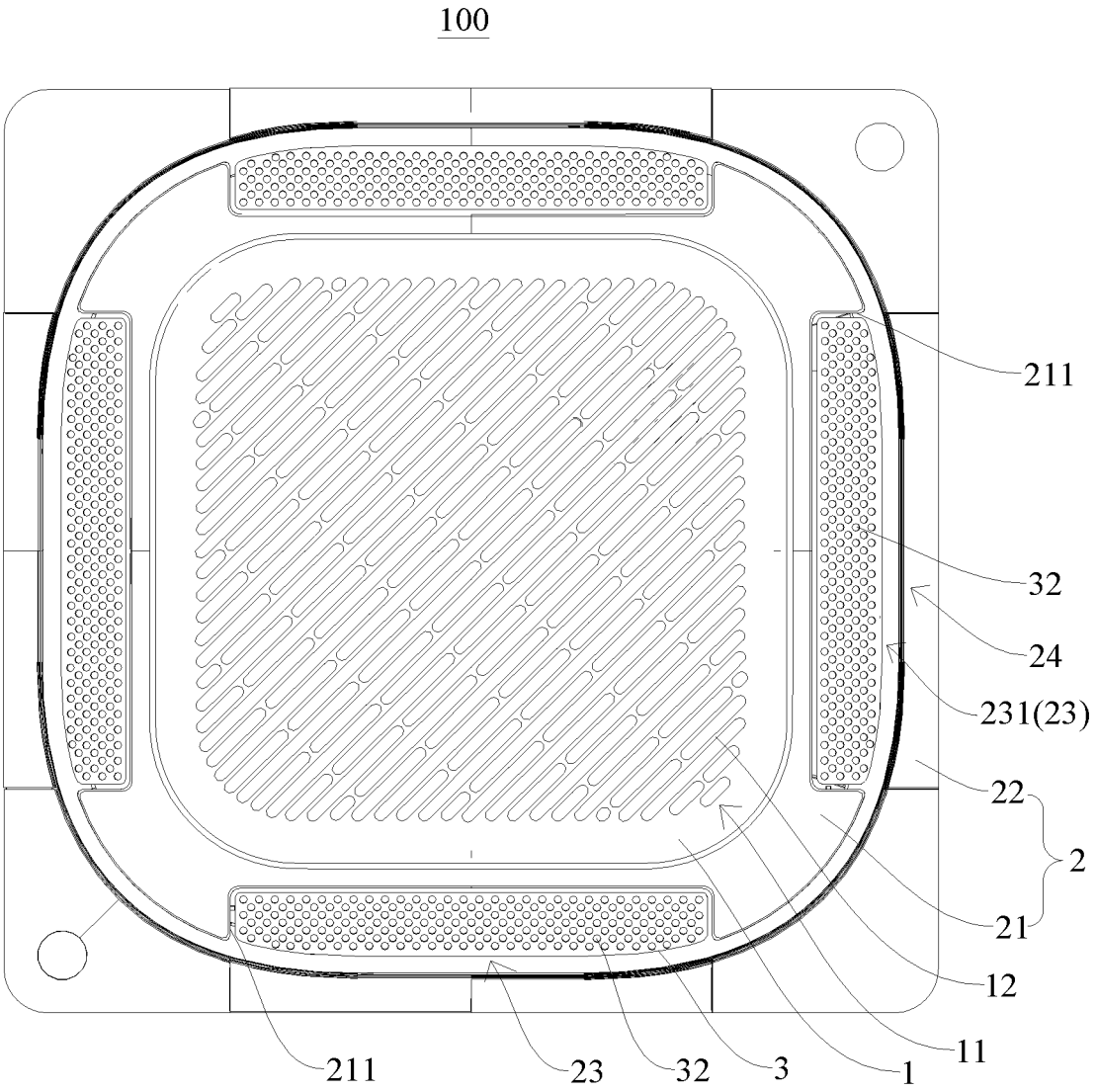
FIG. 1 is a schematic view of a panel assembly in an embodiment of the present disclosure.

REFERENCE NUMERALS ceiling-embedded air conditioner 1000
panel assembly 100
panel 1, air inlet 11, air inlet grille 12
panel frame 2, first panel frame 21, notch 211, second panel frame 22, air outlet 23, adjustable port 231, port inner edge 2311, port outer edge 2312, air baffle rib 24
adjustable plate 3, rotation shaft 31, windless-feeling perforation 32, plate inner edge 33, plate outer edge 34
body 200.

DETAILED DESCRIPTION

Embodiments of the present disclosure are further described. Examples of the embodiments are illustrated in the accompanying drawings. Same or similar reference signs represent the same or similar components or components that have the same or similar functions from beginning to end. The embodiments described below with reference to the accompanying drawings are exemplary, are merely used to explain the present disclosure, and cannot be construed as a limitation to the present disclosure.

In the specification of the present disclosure, it is to be understood that, terms such as "upper," "lower," "front," "vertical," "horizontal," "inner," "outer," "axial," "radial" indicate the orientation or position relationship based on the orientation or position relationship illustrated in the drawings only for convenience of description or for simplifying description of the present disclosure, and do not indicate or imply that the device or element referred to must have a particular orientation or be constructed and operated in a specific orientation, and hence cannot be construed as limitation to the present disclosure. In addition, a feature associated with "first" and "second" may comprise one or more of this feature. In the description of the present disclosure, the term "a plurality of" means two or more than two, unless specified otherwise.

In the present disclosure, it should be noted that, unless specified otherwise, terms "mounted," "coupled," and "connected," are used broadly, for example, may be fixed connections, detachable connections, or integral connections; may also be mechanical or electrical connections; may also be direct connections or indirect connections via intervening structures; may also be inner communications of two elements, which may be understood by those skilled in the related art according to specific situations.

The panel assembly 100 of the ceiling-embedded air conditioner according to an embodiment of the present disclosure is described below with reference to FIGS. 1-3.

Figure 2:
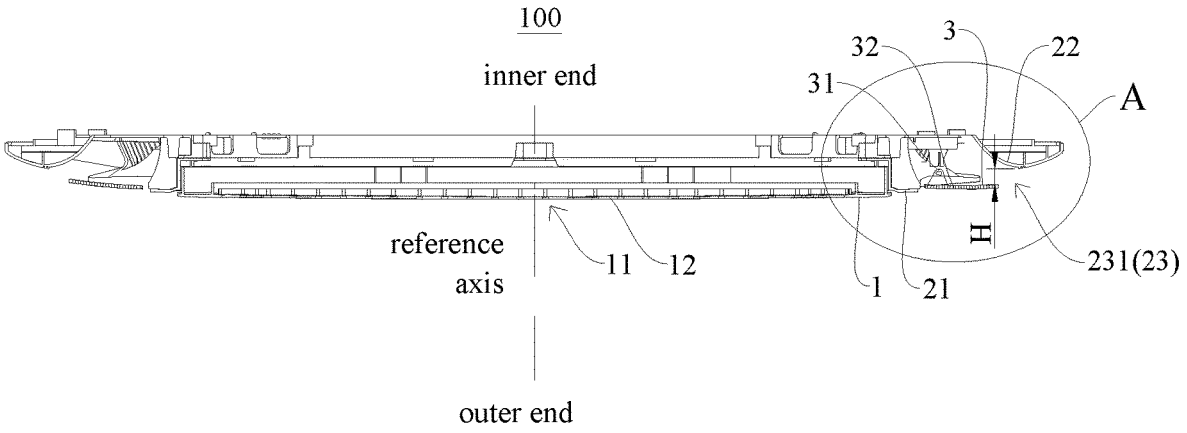
FIG. 2 is a sectional view of a panel assembly in an embodiment of the present disclosure.

As shown in FIG. 1 and FIG. 2, the panel assembly 100 of the ceiling-embedded air conditioner according to the embodiment of the present disclosure includes a panel frame 2 and an adjustable plate 3.

As shown in FIG. 2, the panel frame 2 has a reference axis, two ends of the reference axis are an inner end and an outer end arranged at an inner side and an outer sides of the panel assembly 100, respectively, and the panel frame 2 is provided with one or more air outlets 23 surrounding the reference axis. It may be understood that the reference axis is not a physical structure line on the panel assembly 100, but a reference line referenced for convenience of structure description. The panel frame 2 may be provided with an air outlet 23 surrounding the reference axis. The air outlet 23 may be in annular, arc, vortex shape, and the like, which may achieve the air supply effect and facilitate molding of the panel frame 2. The panel frame 2 may also be provided with a plurality of air outlets 23, which surround the reference axis. Each air outlet 23 may be in linear, curved or zig-zag shape, which may improve an air supply volume of the panel frame 2 and the air supply effect of the panel frame 2.

As shown in FIG. 1 and FIG. 2, at least one air outlet 23 is an adjustable port 231. When there are a plurality of air outlets 23, the plurality of air outlets 23 may be all adjustable ports 231 or a part of the plurality of air outlets 23 may be the adjustable ports 321. As shown in FIG. 3, the adjustable port 231 has a port inner edge 2311 close to the reference axis and a port outer edge 2312 away from the reference axis. On the reference axis, a projection of the port inner edge 2311 is located on a side of the projection of the port outer edge 2312 facing the outer end. Thus, in a direction of the reference axis, the port inner edge 2311 is close to the outer end, the port outer edge 2312 is close to the inner end, and there is a height difference H between the port inner edge 2311 and the port outer edge 2312 of the adjustable port 231. The ceiling-embedded air conditioner 1000 is usually mounted at top of a house. The outer end of the reference axis on the panel assembly 100 is arranged downward and the inner end of the reference axis on the panel assembly 100 is arranged upward, and that is, the reference axis is arranged along an up-down direction. Thus, a distance difference between structures on the panel assembly 100 in the direction of the reference axis may also be referred to as the height difference. Of course, the height difference quoted here is only used to represent the distance difference between different structures in the direction of the reference axis. When the ceiling-embedded air conditioner 1000 is mounted obliquely or on a wall of the house, the reference axis is no longer arranged along the up-down direction, and the height difference mentioned herein is still the distance difference between different structures in the direction of the reference axis.

Figure 3:
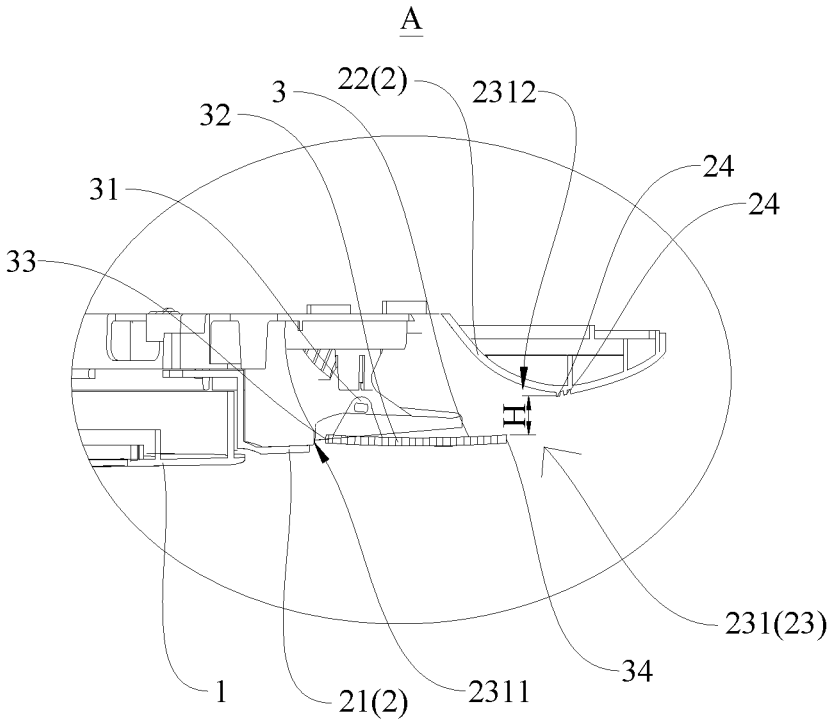
FIG. 3 is a partially enlarged view of part A in FIG. 2.

As shown in FIG. 3, the adjustable plate 3 may be movably arranged at the adjustable port 231. The adjustable plate 3 has a low-wind-feeling position. An edge of the adjustable plate 3 close to the reference axis is a plate inner edge 33, and an edge of the adjustable plate 3 away from the reference axis is the plate outer edge 34. In the low-wind-feeling position, the plate inner edge 33 is close to or linked to the port inner edge 2311, and a radial air outlet is formed between the plate outer edge 34 and the port outer edge 2312. The radial air outlet is configured to output air in a direction away from the reference axis. It may be understood that, through the movable arrangement of the adjustable plate 3 at the adjustable port 231, the plate inner edge 33 may be close to or linked to the port inner edge 2311. In the direction of the reference axis, there is a height difference between the plate outer edge 34 and the port outer edge 2312, which may be formed with a radial air outlet, such that the supplied airflow may blow in a direction away from the reference axis.

It should be noted that for some panel assemblies in the related art, when the ceiling-embedded air conditioner is in a heating mode, an air guide plate rotates to guide the air vertically downward, and that is, the air guide plate makes the air outlet form an air-output direction parallel to the axis. When the ceiling-embedded air conditioner is in a cooling mode, the air guide plate rotates and tilts downward to guide the air, and that is, the air guide plate makes the air outlet form an air-output direction at an angle ranging from 45 degrees to 60 degrees with the axis. When the ceiling-embedded air conditioner is in a windless-feeling mode, the air guide plate closes the air outlet and only outputs air by means of pores on the air guide plate. In the above technical solution, under the first two modes, the ceiling-embedded air conditioner provides strong feeling of air, which is easy to blow directly to user's head and reduce a use comfort, and an air volume is too low in the windless-feeling mode, which is not applicable when an indoor temperature is greatly different from a set temperature of the air conditioner.

In the panel assembly 100 of the present disclosure, the adjustable plate 3 may be moved to the low-wind-feeling position, such that the ceiling-embedded air conditioner 1000 has a low-wind-feeling mode, so as to be formed with the radial air outlet, thereby reducing the direct blowing of the airflow to the user, protecting the user's health and improving the comfort experience for user.

Of course, the adjustable plate 3 may be moved to the low-wind-feeling position, and the adjustable plate 3 may also move to other positions. For example, in the heating mode, the adjustable plate 3 may rotate to guide the air vertically downward. In the windless-feeling mode, the adjustable plate 3 closes the adjustable port 231. In the cooling mode, when the user gets used to cooling air or there are few people indoors, the air-output direction may be adjusted to a certain angle with the reference axis (e.g., 45 degrees to 75 degrees). When the user is not comfortable with the cooling air, the adjustable plate 3 may be adjusted to the low-wind-feeling position. Thus, multiple needs of users may be met. It should be noted that the supplied airflow may directly blow to the user, but the use time needs to be controlled. When the user needs to use for a short time, the supplied airflow needs to be as close to the user as possible, so as to quickly provide the user with a comfortable temperature. When the user needs to use for a long time, the direct blowing of the airflow to the user needs to be reduced, so as to reduce physical discomfort such as headache, nasal congestion and other air conditioning diseases, caused by the supplied airflow directly blowing to the user.

For the panel assembly 100 of the ceiling-embedded air conditioner according to the embodiment of the present disclosure, through the movable arrangement of the adjustable plate 3 at the adjustable port 231, when the plate inner edge 33 is close to or linked to the port inner edge 2311, there is a height difference between the plate outer edge 34 and the port outer edge 2312 in the direction of the reference axis, and a radial air outlet may be formed, such that the supplied airflow may blow in a direction away from the reference axis, so as to reduce the direct blowing of the airflow to the user, protect the user's health and improve the comfort experience for user.

In some embodiments, as shown in FIG. 2 and FIG. 3, at the low-wind-feeling position, the air-output direction of the radial air outlet is perpendicular to the reference axis, and that is, on a section of the reference axis, center line of the radial air outlet is perpendicular to the reference axis. In this way, the low-wind-feeling effect of the panel assembly 100 may be further improved, the blowing of the airflow to the user may be reduced as much as possible, and the airflow blowing towards a surface of the panel assembly 100 may be reduced, so as to improve a utilization rate of air conditioning blowing for air heat exchange.

Of course, in other embodiments, the center line of the radial air outlet may also form an included angle of less than 5 degrees with the reference axis. In this way, in the indoor space, when the ceiling-embedded air conditioner 1000 is mounted at a roof, the radial air outlet may merely blow directly to the wall rather than the user's head.

In some embodiments, as shown in FIG. 3, in the low-wind-feeling position, a projection of the plate outer edge 34 is located in a projection of the adjustable port 231 on the reference axis. On the one hand, shape of the adjustable plate 3 does not need to be made too bent to ensure that the air-output direction can be adjusted to an appropriate angle during heating. On the other hand, in the low-wind-feeling position, the adjustable plate 3 is basically located within a range of the adjustable port 231, and a protruding part is small or even there is no protruding part. In this way, when the airflow is strong, the adjustable plate 3 may contact the panel frame 2 to obtain the protection of the panel frame 2 and reduce jitter, such that the adjustable plate 3 may well guide the airflow and reduce a loss of the airflow.

In some embodiments, as shown in FIG. 3, in the low-wind-feeling position, an appearance surface of the adjustable plate 3 is tangent to an appearance surface of the panel frame 2 at the plate inner edge 33. In this way, appearance integrity of the panel assembly 100 and aesthetics of the panel assembly 100 may be improved.

In some embodiments, as shown in FIG. 3, the distance between the port inner edge 2311 and the port outer edge 2312 in the direction of the reference axis is greater than 10 mm and less than 30 mm, such that the panel assembly 100 may have a suitable air supply volume. For example, when the panel assembly 100 is suitable for assembly of the ceiling-embedded air conditioner 1000, a reasonable air supply volume may improve operation efficiency of the ceiling-embedded air conditioner 1000. For example, during the use, a reasonable air supply volume is conducive to improving the comfort experience for user.

In some embodiments, as shown in FIGS. 1 and 2, the panel assembly 100 of the ceiling-embedded air conditioner also includes: panel 1, the panel 1 is provided with an air inlet 11, the panel frame 2 is in annular shape, the panel frame 2 is fitted over the panel 1, and the reference axis is located on a central axis of the air inlet 11. It may be understood that the panel frame 2 may fix and limit the panel 1, improve mounting stability of the panel 1 and improve safety of the panel assembly 100. In addition, a firm mounting of panel 1 is also conducive to reducing an input-air noise at the air inlet 11.

Specifically, as shown in FIGS. 1 and 2, the panel frame 2 includes a first panel frame 21 and a second panel frame 22. The first panel frame 21 is in annular shape, the first panel frame 21 is fitted over an outer circumference of the panel 1, and a plurality of notches spaced apart from each other are arranged at an outer edge of the first panel frame 21. The second panel frame 22 is in annular shape, the second panel frame 22 is fitted over an outer circumference of the first panel frame 21, an air outlet 23 is formed between an inner wall of each notch and an inner peripheral wall of the second panel frame 22. It may be understood that the arrangement of the first panel frame 21 may fix and limit the panel 1 and improve the mounting stability of the panel 1. The first panel frame 21 may also be formed with a plurality of notches spaced apart from each other and at an outer edge of the first panel frame, so as to improve air volume of the air passing through the first panel frame 21 and improve the air supply efficiency of the panel assembly 100. Moreover, an inner wall of each notch may further guide the flow of airflow.

The arrangement of the second panel frame 22 may fix and limit the first panel frame 21, so as to improve the mounting stability of the first panel frame 21. The second panel frame 22 may further guide the flow of airflow, such that the air flows along an inner peripheral wall of the second panel frame 22.

In some optional embodiments, as shown in FIG. 1 and FIG. 2, all of the plurality of air outlets 23 are adjustable ports 231, each of the adjustable ports 231 is provided with a rotatable adjustable plate 3, and a rotation shaft 31 of the adjustable plate 3 is arranged close to the port inner edge 2311. It may be understood that all of the plurality of air outlets 23 are the adjustable ports 231, which may improve the windless-feeling effect of the panel assembly 100. Specifically, the adjustable plate 3 is rotatable around the rotation shaft 31, so as to change a position of the adjustable plate 3 of the rotation shaft 31, and then the air-output direction of the panel assembly 100 may be changed. The rotation shaft 31 of the adjustable plate 3 is arranged close to the port inner edge 2311, such that when the adjustable plate 3 rotates close to the plate inner edge 33 or to be linked to the port inner edge 2311, the panel assembly 100 may output air radially, which may reduce the discomfort caused by the directly blowing to the user for a long time. In addition, the rotation shaft 31 of the adjustable plate 3 is arranged close to the port inner edge 2311, which may also reduce the exposure of the supplied airflow between the port inner edge 2311 and the plate inner edge 33 as much as possible, so as to further improve the comfort experience for user.

Of course, in some other embodiments, the adjustable plate 3 may also be arranged with to be slidable to open and close, the arrangement may also achieve the above functions, and action manners of the adjustable plate 3 is not limited herein.

In some optional embodiments, as shown in FIG. 1 and FIG. 2, the panel 1 is integrated with an air inlet grille 12 at the air inlet 11. It may be understood that the arrangement of the air inlet grille 12 may improve cleanliness of interior of the panel assembly 100, reduce the entry of dust and other particles carried in the airflow into the interior of the panel assembly, so as to improve the service life of the panel assembly 100.

Optionally, as shown in FIGS. 1 and 2, the air guide plate is provided with a windless-feeling perforation 32. It may be understood that during operation, the airflow at air outlet 23 is relatively concentrated and the air speed is relatively large. The arrangement of the windless-feeling perforation 32 may disperse the airflow, reduce intensity of the airflow such that the output air is softer and more uniform.

Optionally, as shown in FIG. 3, an air baffle rib 24 is provided at the port outer edge 2312. It may be understood that a temperature difference between the port outer edge 2312 and the airflow is large, and when the airflow blows there, it is easy to form condensate water. Thus, the arrangement of the air baffle rib 24 at the port outer edge 2312 may block the airflow and reduce the direct blowing of the airflow to this place, so as to reduce the condensate water formed on the panel frame 2, reduce the problems such as water blowing or dripping of the condensate water, and improve the comfort experience for users. In addition, the air baffle rib 24 may also improve structural strength of the panel frame 2 and improve a fatigue life of the panel assembly 100.

The panel assembly 100 of the ceiling-embedded air conditioner in a specific embodiment of the present disclosure is described below with reference to FIGS. 1-3.

The panel assembly 100 of the ceiling-embedded air conditioner according to the embodiment of the present disclosure includes a panel 1, a panel frame 2 and an adjustable plate 3.

The panel 1 is provided with an air inlet 11, the panel frame 2 is fitted over the panel 1, and the reference axis is located on a central axis of the air inlet 11. The panel 1 is integrated with an air inlet grille 12 at the air inlet 11.

The panel frame 2 has a reference axis, and two ends of the reference axis are an inner end and an outer end arranged at an inner side and an outer side of the panel assembly 100, respectively. The panel frame 2 includes a first panel frame 21 and a second panel frame 22. The first panel frame 21 is in annular shape, the first panel frame 21 is fitted over an outer circumference of the panel 1, and a plurality of notches 211 spaced apart from each other are arranged at an outer edge of the first panel frame 21. The second panel frame 22 is in annular shape, the second panel frame 22 is fitted over an outer circumference of the first panel frame 21, and an air outlet 23 is formed between an inner wall of each notch 211 and an inner peripheral wall of the second panel frame 22. All of the plurality of air outlets 23 are adjustable ports 231. The adjustable port 231 has a port inner edge 2311 close to the reference axis and a port outer edge 2312 away from the reference axis. A distance between the port inner edge 2311 and the port outer edge 2312 in a direction of the reference axis is greater than 10 mm and less than 30 mm.

The adjustable plate 3 is rotatably arranged at the adjustable port 231, and the rotation shaft 31 of the adjustable plate 3 is arranged close to the port inner edge 2311. The adjustable plate 3 has a low-wind-feeling position. An edge of the adjustable plate 3 close to the reference axis is a plate inner edge 33, and an edge of the adjustable plate 3 away from the reference axis is a plate outer edge 34. In the low-wind-feeling position, the plate inner edge 33 is close to or linked to the port inner edge 2311, a projection of the plate outer edge 34 is located in a projection of the adjustable port 231, the adjustable plate 3 is tangent to the panel frame 2 at the plate inner edge 33, a radial air outlet is formed between the plate outer edge 34 and the port outer edge 2312, and an air-output direction of the radial air outlet is perpendicular to the reference axis. The adjustable plate 3 is provided with a windless-feeling perforation 32.

A ceiling-embedded air conditioner 1000 according to an embodiment of the present disclosure is described below with reference to the accompanying drawings.

Figure 4:
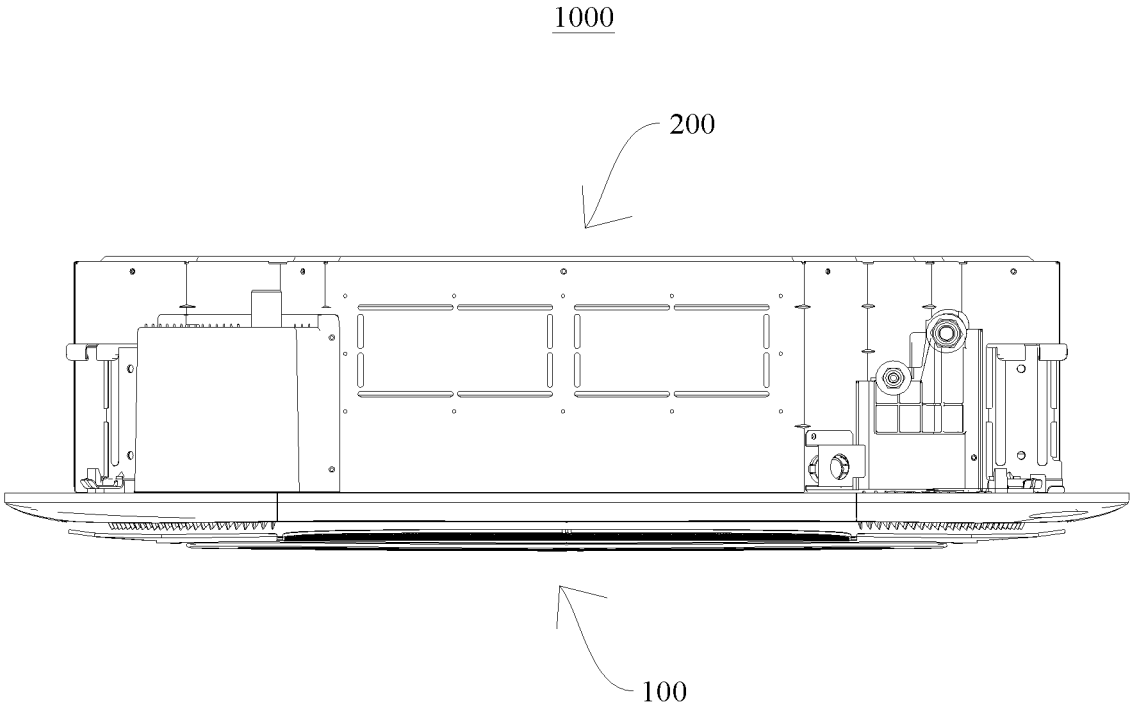
FIG. 4 is a schematic view of a ceiling-embedded air conditioner in an embodiment of the present disclosure.

The ceiling-embedded air conditioner 1000 according to the embodiments of the present disclosure, as shown in FIGS. 2 and 4, includes a panel assembly 100 of the ceiling-embedded air conditioner according to the above embodiment of the present disclosure. The structure of the panel assembly 100 has been described in detail above and is not repeated herein.

For the ceiling-embedded air conditioner 1000 according to the embodiments of the present disclosure, through the movable arrangement of the adjustable plate 3 at the adjustable port 231, when the plate inner edge 33 is close to or linked to the port inner edge 2311, there is a height difference between the plate outer edge 34 and the port outer edge 2312 in the direction of the reference axis, and a radial air outlet may be formed, such that the supplied airflow may blow in a direction away from the reference axis, so as to reduce the direct blowing of the airflow to the user, protect the user's health and improve the comfort experience for user.

Optionally, as shown in FIG. 4, the ceiling-embedded air conditioner 1000 also includes a body 200 connected with the panel assembly 100. In this way, the body 200 may fix and limit the panel assembly 100 and improve the mounting stability of the panel assembly 100. Of course, the body 200 may also provide other structural mounting positions. Other structures here refer to axial flow fans and electric control boxes, which are known to those skilled in the art and is not described in detail herein.

Reference throughout this specification to "an embodiment," "an example" means that a particular feature, structure, material, or characteristic described in connection with the embodiment or example is included in at least one embodiment or example of the present disclosure. In this specification, exemplary descriptions of aforesaid terms are not necessarily referring to the same embodiment or example. Furthermore, the particular features, structures, materials, or characteristics may be combined in any suitable manner in one or more embodiments or examples.

Although embodiments of present disclosure have been shown and described above, it should be understood by those skilled in the art that above embodiments are just explanatory, and cannot be construed to limit the present disclosure, changes, modifications, alternatives and variations can be made to the embodiments without departing from the scope of the present disclosure.

What is claimed is:

1. A panel assembly comprising:

a panel frame provided with one or more air outlets surrounding a reference axis of the panel frame, wherein:

the reference axis has an inner end and an outer end arranged at an inner side and an outer side of the panel assembly, respectively;

the one or more air outlets include an adjustable port, the adjustable port having a port inner edge close to the reference axis and a port outer edge away from the reference axis; and on the reference axis, a projection of the port inner edge is located on a side of a projection of the port outer edge facing the outer end; and an adjustable plate movably arranged at the adjustable port and having a low-wind-feeling position, at which:

a plate inner edge of the adjustable plate that is close to the reference axis is linked to the port inner edge, and a radial air outlet is formed between the port outer edge and a plate outer edge of the adjustable plate that is away from the reference axis, the radial air outlet being configured to output air in a direction away from the reference axis.

2. The panel assembly according to claim 1, wherein, at the low-wind-feeling position, an air-output direction of the radial air outlet is perpendicular to the reference axis.

3. The panel assembly according to claim 1, wherein at the low-wind-feeling position, a projection of the plate outer edge is located inside a projection of the adjustable port on the reference axis.

4. The panel assembly according to claim 1, wherein at the low-wind-feeling position, an appearance surface of the adjustable plate is tangent to an appearance surface of the panel frame at the plate inner edge.

5. The panel assembly according to claim 1, wherein a distance between the port inner edge and the port outer edge in a direction of the reference axis is greater than 10 mm and less than 30 mm.

6. The panel assembly according to claim 1, further comprising:

a panel provided with an air inlet;

wherein:

the panel frame is in annular shape and is fitted over the panel; and the reference axis is located on a central axis of the air inlet.

7. The panel assembly according to claim 6, wherein the panel frame includes:

a first panel frame in annular shape and fitted over an outer circumference of the panel, a plurality of notches spaced apart from each other being arranged at an outer edge of the first panel frame; and a second panel frame in annular shape and fitted over an outer circumference of the first panel frame, each of the one or more air outlets being formed between an inner wall of one of the plurality of notches and an inner peripheral wall of the second panel frame.

8. The panel assembly according to claim 6, wherein the panel is integrated with an air inlet grille at the air inlet.

9. The panel assembly according to claim 1, wherein each of the one or more air outlets is an adjustable port provided with a rotatable adjustable plate, and a rotation shaft of the adjustable plate is arranged close to a port inner edge of the corresponding adjustable port.

10. A ceiling-embedded air conditioner comprising:

a panel assembly including:

a panel frame provided with one or more air outlets surrounding a reference axis of the panel frame, wherein:

the reference axis has an inner end and an outer end arranged at an inner side and an outer side of the panel assembly, respectively;

the one or more air outlets include an adjustable port, the adjustable port having a port inner edge close to the reference axis and a port outer edge away from the reference axis; and on the reference axis, a projection of the port inner edge is located on a side of a projection of the port outer edge facing the outer end; and an adjustable plate movably arranged at the adjustable port and having a low-wind-feeling position, at which:

a plate inner edge of the adjustable plate that is close to the reference axis is linked to the port inner edge, and a radial air outlet is formed between the port outer edge and a plate outer edge of the adjustable plate that is away from the reference axis, the radial air outlet being configured to output air in a direction away from the reference axis.

11. The ceiling-embedded air conditioner according to claim 10, wherein, at the low-wind-feeling position, an air-output direction of the radial air outlet is perpendicular to the reference axis.

12. The ceiling-embedded air conditioner according to claim 10, wherein at the low-wind-feeling position, a projection of the plate outer edge is located inside a projection of the adjustable port on the reference axis.

13. The ceiling-embedded air conditioner according to claim 10, wherein at the low-wind-feeling position, an appearance surface of the adjustable plate is tangent to an appearance surface of the panel frame at the plate inner edge.

14. The ceiling-embedded air conditioner according to claim 10, wherein a distance between the port inner edge and the port outer edge in a direction of the reference axis is greater than 10 mm and less than 30 mm.

15. The ceiling-embedded air conditioner according to claim 10, wherein:

the panel assembly further includes a panel provided with an air inlet;

the panel frame is in annular shape and is fitted over the panel; and the reference axis is located on a central axis of the air inlet.

16. The ceiling-embedded air conditioner according to claim 15, wherein the panel frame includes:

a first panel frame in annular shape and fitted over an outer circumference of the panel, a plurality of notches spaced apart from each other being arranged at an outer edge of the first panel frame; and a second panel frame in annular shape and fitted over an outer circumference of the first panel frame, each of the one or more air outlets being formed between an inner wall of one of the plurality of notches and an inner peripheral wall of the second panel frame.

17. The ceiling-embedded air conditioner according to claim 15, wherein the panel is integrated with an air inlet grille at the air inlet.

18. The ceiling-embedded air conditioner according to claim 10, wherein each of the one or more air outlets is an adjustable port provided with a rotatable adjustable plate, and a rotation shaft of the adjustable plate is arranged close to a port inner edge of the corresponding adjustable port.

* * * * *